US006532702B1

(12) United States Patent
Scribner

(10) Patent No.: US 6,532,702 B1
(45) Date of Patent: Mar. 18, 2003

(54) BUILDING FIXTURE PROTECTION APPARATUS HAVING PROTECTIVE PANELS AND A PLURALITY OF QUICK CONNECT/DISCONNECT MEANS

(76) Inventor: Paul J. Scribner, 517 Banyan Rd., Newark, DE (US) 19713

( * ) Notice: Subject to any disclaimer, the term of this patent is extended or adjusted under 35 U.S.C. 154(b) by 0 days.

(21) Appl. No.: 09/531,823

(22) Filed: Mar. 21, 2000

(51) Int. Cl.[7] ..... E06B 3/26

(52) U.S. Cl. ..... 52/202; 52/203; 52/208; 52/745.16; 49/63; 411/348

(58) Field of Search ..... 52/202, 203, 208, 52/476, 741.3, 745.06, 745.16, DIG. 12; 411/348; 49/63

(56) References Cited

U.S. PATENT DOCUMENTS

| | | | | | |
|---|---|---|---|---|---|
| 1,699,079 | A | | 1/1929 | Ruchie | |
| 2,519,132 | A | | 8/1950 | Hansen | |
| 3,183,586 | A | * | 5/1965 | Sellers | 411/348 X |
| 4,656,778 | A | | 4/1987 | Fiorenza, Sr. | |
| 4,733,510 | A | * | 3/1988 | Werner | 52/202 |
| 5,061,112 | A | * | 10/1991 | Monford, Jr. | 411/348 X |
| 5,596,849 | A | * | 1/1997 | Hill | 52/202 |
| 5,603,190 | A | * | 2/1997 | Sanford | 52/202 |
| 5,857,298 | A | * | 1/1999 | Fullwood | 52/202 |
| RE36,351 | E | * | 10/1999 | Yamamoto et al. | 411/348 X |
| 6,014,841 | A | * | 1/2000 | McCory, Jr. et al. | 52/19 |
| 6,077,011 | A | * | 6/2000 | Walker | 411/348 |
| 6,230,455 | B1 | * | 5/2001 | Arehart et al. | 52/202 |
| 6,269,597 | B1 | * | 8/2001 | Haas | 52/203 |

* cited by examiner

*Primary Examiner*—Carl D. Friedman
*Assistant Examiner*—Brian E. Glessner

(57) ABSTRACT

A building fixture protection apparatus that covers and quickly connects and disconnects from an existing building fixture, such as windows and doors, to protect the building fixture from damage due to vandalism, hurricanes, tornados, high winds, or other types of dangerous storms. The building fixture protection apparatus comprises a panel member that is sized to cover a portion or all of the building fixture, and a plurality of connecting members provided at select portions of the panel member. The plurality of connecting members quickly connect and disconnect the panel member to and from a plurality of mating connecting members provided in the periphery around the building fixture. The building fixture protection apparatus easily fits over the building fixture in a minimal amount of time, facilitating the process of safeguarding a building fixture prior to the arrival of vandals or a dangerous storm.

15 Claims, 1 Drawing Sheet

BUILDING FIXTURE PROTECTION APPARATUS HAVING PROTECTIVE PANELS AND A PLURALITY OF QUICK CONNECT/DISCONNECT MEANS

BACKGROUND OF THE INVENTION

A. Field of the Invention

The present invention relates generally to a building fixture protection apparatus, and, more particularly to a building fixture protection apparatus having protective panels and a plurality of quick connect/disconnect means, wherein the building fixture protection apparatus easily fits over an existing building fixture in a minimal amount of time, facilitating the process of safeguarding the building fixture prior to the arrival of vandals or a dangerous storm.

B. Description of the Related Art

Buildings and homes may suffer destruction from a variety of sources. One such source is vandalism. U.S. News and World Reports estimated vandalism costs to exceed $4.22 billion in the United States alone. Of this, $600 million is attributable to replacements of glass. A recurring problem throughout the country is the destruction of windows and doors of unoccupied buildings caused by rampant vandals.

Another source of home and building destruction is violent storms, such as hurricanes, gales, high winds, tropical storms, and tornados. A powerful hurricane, for example, can kill more people and destroy more property than any other natural disaster. In the United States, the hurricane death toll has greatly diminished due to timely warnings of approaching storms, but damage to homes and buildings continues to mount. In 1999, hurricane-caused property damage amounted to $100 billion.

During hurricanes, tornados, and gales homes and buildings may be damaged by high winds and wind-borne debris. As winds increase, pressure exerted to such structures increases a disproportionate rate. The pressure force exerted on structures increases with the square of the wind speed so that a threefold increase in windspeed gives a ninefold increase in pressure. A 25 mph wind causes 1.6 pounds of pressure per square foot. Thus, a four-by-eight sheet of plywood will be pushed by a force of 50 pounds. In 75 mph winds, that force becomes 450 pounds, and in 125 mph winds, it becomes 1,250 pounds.

If windows, doors, and other similar building fixtures are not protected from vandals' rocks (or other objects) and storms' high winds, such fixtures invariably become destroyed, allowing entry into the building by vandals or allowing high winds inside the home or building. Once vandals or high winds enter a structure, further destruction typically ensues.

To safeguard against this, the conventional solution has been to nail sheets of plywood over windows, doors, and similar building fixtures to provide as much protection for the home or building as possible. Unfortunately, this is a labor-intensive and time-consuming task, and many individuals procrastinate as long as possible, largely due to this factor, and sometimes in hopes that the track of the storm will deviate and the full force of the storm will not be realized. Another problem, especially for the elderly, is that they are unable to lift heavy sheets of plywood even if they wanted to protect their home fixtures in such a manner. Still another problem associated with the conventional solution is that once the storm is over or when the building is to become occupied, removal of the plywood and nails causes damage to the fixture, especially portion of the building where the nails are removed from. These factors further exasperate the problem associated with protecting one's home or building from the destructive force of vandals and storms.

The related art patents, including U.S. Pat. Nos. 1,699,079, 2,519,132, and 4,656,778, typically disclose providing a storm window assembly externally to a conventional window. All of the storm window assemblies described in these references include unprotected glass storm windows that are just as vulnerable to breakage as the conventional window. Furthermore, U.S. Pat. Nos. 2,519,132 and 4,656,778 both use screws to attach the storm window assembly, providing a task as labor-intensive and time-consuming as nailing sheets of plywood over windows. U.S. Pat. No. 1,699,079 discloses removably attaching the storm window assembly via hook clips. However, such hook clips enable the assembly to be swingably supported rather than fixedly supported against the conventional window.

Thus, there exists a need in the art for an easier, less labor-intensive and time-consuming way to protect a home or building from storms and vandals.

SUMMARY OF THE INVENTION

An object of the invention is to provide an easier, less labor-intensive and time-consuming way to protect a home or building from storms and vandals.

Another object of the present invention is to provide a means for protecting a home or a building from a storm or vandals that is lightweight and easy to install.

Still a further object of the present invention is to provide a means for protecting a home or a building from a storm or vandals that does not damage the existing fixture upon removal.

Additional objects and advantages of the invention will be set forth in part in the description which follows, and in part will be learned from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, one aspect of the invention comprises a building fixture protection apparatus that quickly connects and disconnects from a periphery around an existing building fixture to protect the building fixture from damage, the building fixture protection apparatus including: a panel member sized to cover at least a portion of the building fixture; and a plurality of connection means provided at select portions of the panel member, the plurality of connection means quickly connecting and disconnecting the panel member to and from a plurality of mating connection means provided in the periphery around the building fixture.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

In accordance with the invention, the present invention is broadly drawn to a building fixture protection apparatus that quickly connects and disconnects from a periphery around an existing building fixture to protect the building fixture from damage. The building fixture protection apparatus comprises a panel member sized to cover at least a portion of the building fixture, as well as a plurality of connection means provided at select portions of the panel member. The plurality of connection means quickly connect and disconnect the panel member to and from a plurality of mating connection means provided in the periphery around the building fixture.

The building fixture to be protected by the present invention may include any building fixtures vulnerable to damage due to violent storms or vandalism, such as windows and doors. Preferably, the building fixture will be windows since these fixtures are the most vulnerable to damage caused by high winds, debris, and vandalism. The present invention may be used with any building having such building fixtures, including residential housing and commercial buildings, whether occupied or unoccupied.

Figure 1:
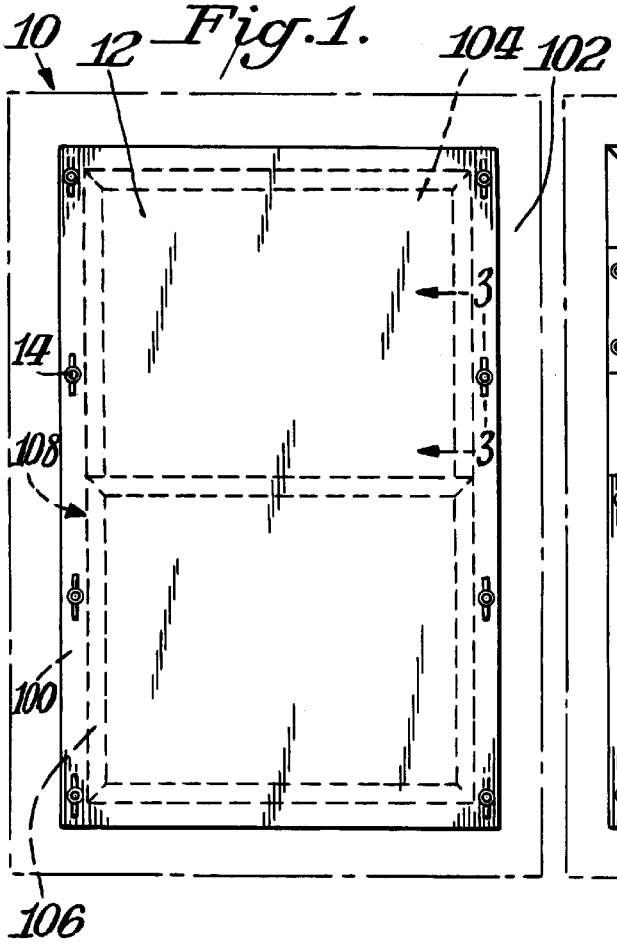
FIG. 1 is a front elevational view showing a building fixture protection apparatus covering a double hung window in accordance with a preferred embodiment of the present invention.
Figure 2:
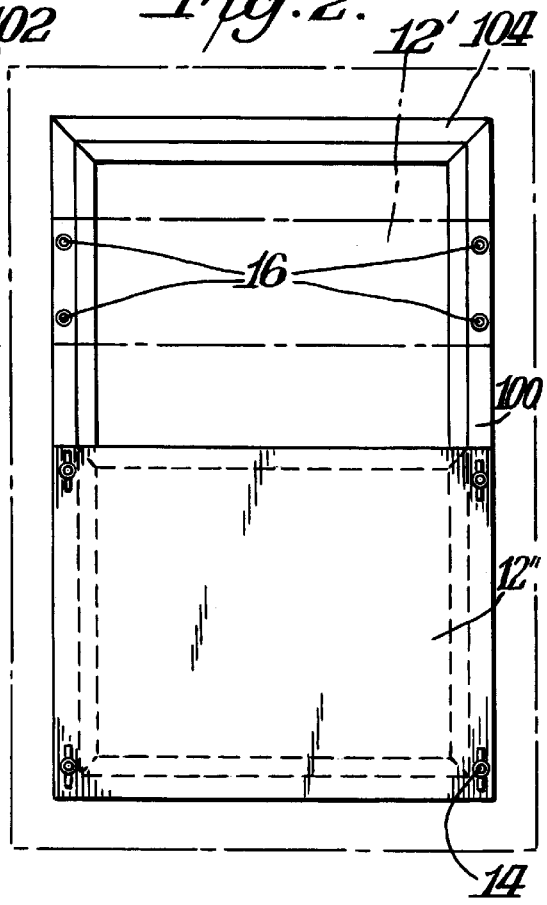
FIG. 2 is a front elevational view showing a building fixture protection apparatus covering a double hung window in accordance with another preferred embodiment of the present invention.
Figure 3:
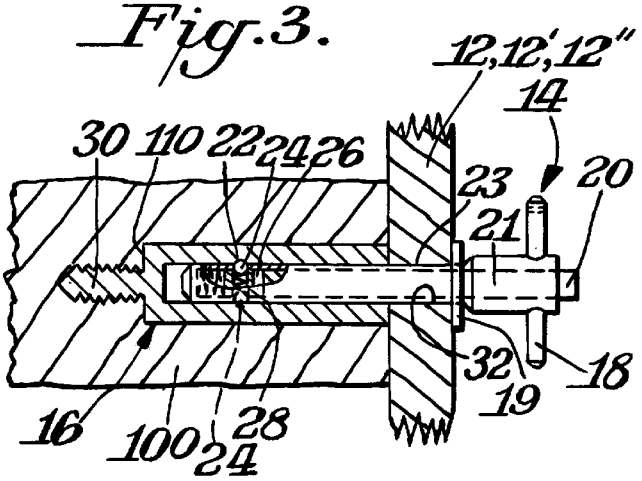
FIG. 3 is a cross-sectional view in side elevation taken along line 3—3 of FIG. 1.

As embodied herein and as shown in FIG. 1, the building fixture protection apparatus 10 comprises a panel member 12 having a plurality of quick connect/disconnect connection means provided therethrough. In the preferred embodiment, each connection means comprises a T-handle release pin, although any type of quick connect/disconnect known to one of ordinary skill in the art may be used. As shown in FIG. 1, panel member 12 covers and protects a window frame 100 formed in a sided wall 102 of a building structure. Window frame 100 is of a typical double hung configuration, having an upper sash 104, a lower sash 106, and a double hung sash 108. T-handle release pins have a male member 14 that quickly connects and disconnects from a female socket 16 provided in window frame 100 (as shown in FIGS. 2 and 3). Panel member 12 is interposed between male member 14 and female socket 16, and thus, may be quickly connected and disconnected from window frame 100, providing complete protection thereto.

Alternatively, as shown in FIG. 2, the panel member, and hence, the building fixture protection apparatus, may cover only a portion of window frame 100. For example, one configuration of the panel member 12' may cover a quarter of window frame 100, while another configuration of the panel member 12" may cover one-half of window frame 100. The variably-sized building fixture protection apparatus of the present invention provides consumers with several choices, enabling, for example, elderly consumers a choice of a smaller, more lightweight building fixture protection apparatus that can be more easily lifted, handled and installed.

FIG. 3 shows how connection means 14 connects panel member 12, 12', 12" to window frame 100. As shown, a counter bore 110 is provided in window frame 100, and female socket 16 is provided in counter bore 110. Female socket 16 has a threaded screw portion 30 at its distal end that screws into window frame 100 and fixes female socket 16 into counter bore 110. Female socket 16 further has an annular groove 22 provided in its interior adjacent its distal end. Male member 14 comprises a head portion 21 integrally connected to a stem 23, a T-handle 18 extending from a head portion 21, and a detent release button 20 provided through head portion 21 and stem 23. Stem 23 of male member 14 includes a two-ball detent mechanism 24, a relief bore 26, and a spring 28 that biases the balls of two ball detent mechanism 24 upward into engagement with annular groove 22 of female socket 16.

Installation of a plurality of the female sockets 16 of the present invention comprises a first step of drilling a plurality of holes in the periphery around the building fixture. For example, a plurality of counter bores 110 are provided in the periphery of window frame 100. Subsequently, threaded screw portion 30 of each female socket 16 is screwed into a corresponding counter bore 110 provided in the periphery around window frame 100 so that the plurality of female sockets 16 are flush with the surface of window frame 100.

To firmly and quickly connect panel member 12 to window frame 100, stem 23 of male member 14 is provided through an opening 32 of panel member 12, and two-ball detent mechanism 24 engages annual groove 22 provided in female socket 16. This process is repeated for each connection means 14 provided with panel member 12. A washer 19 may be provided between head portion 21 of male member 14 and panel member 12, but is not necessary. To quickly disconnect panel member 12 from window frame 100, a user depresses detent release button 20 which compresses spring 28, causing the balls of two-ball detent mechanism 24 to disengage annual groove 22 an retreat into relief bore 26 of stem 23. The user then slides male member 14 completely away from female socket 16. This process is repeated for each quick connect/disconnect connection means provided with panel member 12.

Panel member 12, 12', 12" may be made from various materials having various weights and sizes. For example, the panel member may be manufactured from plywood of various thicknesses and different sizes to enable users to select a building fixture protection apparatus that they could easily lift and that would adapt to the window sizes of their building. A preferred range for the thickness of the panel member is between 0.25 and 1.0 inches. Alternatively, panel member 12, 12', 12" may be made from a molded thermoplastic material or a similar rugged, lightweight material, as would be known to one of ordinary skill in the art (e.g., synthetic or natural rubber).

Figure 4:
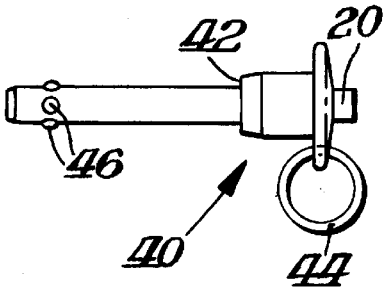
FIG. 4 is a side elevational view of a release pin that can be used to secure the building fixture apparatus of the preferred embodiments.

The connection means of the present invention may comprise any type of quick connect/disconnect means known to one of ordinary skill. FIG. 4, for example, shows a male member 40 of another connection means that may can be used in the present invention. Male member includes a broad shoulder portion 42 (which eliminates any need for a washer), a four-ball detent mechanism 46, and an attachment ring 44 which may be connected to panel member 12 to prevent male member 40 from being lost. Furthermore, the male end of the connection means of the present invention can be a separate component from panel member 12, be slidably connected to panel member 12, or be molded into, i.e., integrally formed with, panel member 12, in the case of a thermoplastic panel member.

The building fixture protection apparatus of the present invention provides an easier, less labor-intensive and time-consuming way to protect home or building fixtures from storms and vandals, than the conventional methods of protection. Furthermore, the building fixture protection apparatus of the present invention provides a means for protecting a home or a building fixture from a storm or vandals that is lightweight, easy to install, and does not damage the existing building fixture upon removal.

It will be apparent to those skilled in the art that various modifications and variations can be made in the building fixture protection apparatus of the present invention and in construction of this building fixture protection apparatus without departing from the scope or spirit of the invention. As an example and as discussed above, various materials, sizes, weights, and thicknesses may be used to construct the panel member of the building fixture protection apparatus. Further, various quick connect/disconnect devices, known to those of ordinary skill in the art, may be used as the connection means and mating connection means. Finally, the building fixture protected by the present invention may include windows, doors, or other building fixtures vulnerable to damage due to violent storms or vandalism.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A building fixture protection apparatus that quickly connects and disconnects from a periphery around an existing building fixture to protect the building fixture from damage, the building fixture protection apparatus comprising:

a panel member sized to cover at least a portion of the building fixture; and a plurality of connection means provided at select portions of the panel member, the plurality of connection means quickly connecting and disconnecting the panel member to and from a plurality of mating connection means provided in the periphery around the building fixture, wherein each of the plurality of connection means comprises a spring-loaded locking insert having a pushbutton release on one end and a detent mechanism on another end, the pushbutton release enabling the detent mechanism to retract upon removal of the building fixture protection apparatus, and wherein each of the plurality of mating connection means comprises an insert receptacle for receiving the detent mechanism of the spring-loaded locking insert, and a threaded screw extending from a bottom of the insert receptacle for permanently connecting each mating connection means directly into the periphery around the building fixture.

2. The building fixture protection apparatus as recited in claim 1, wherein the panel member comprises one of a wood, plastic, synthetic rubber, or natural rubber material.

3. The building fixture protection apparatus as recited in claim 1, wherein the panel member has a thickness in the range of 0.25 inches to 1.0 inches.

4. The building fixture protection apparatus as recited in claim 1, wherein the building fixture comprises one of a door or a window.

5. The building fixture protection apparatus as recited in claim 1, wherein the building fixture protection apparatus protects the building fixture from damage caused by one of storms or vandals.

6. A method of installing a building fixture protection apparatus having a panel member sized to cover at least a portion of the building fixture, and a plurality of connection means permanently fixed to select portions of the panel member, the building fixture protection apparatus quickly connects and disconnects from a periphery around an existing building fixture to protect the building fixture from damage, wherein each of the plurality of connection means comprises a spring-loaded locking insert having a pushbutton release on one end and a detent mechanism on another end, the pushbutton release enabling the detent mechanism to retract upon removal of the building fixture protection apparatus, and wherein each of a plurality of mating connection means comprises an insert receptacle for receiving the detent mechanism of the spring-loaded locking insert, and a threaded screw extending from a bottom of the insert receptacle for permanently fixing each mating connection means directly into the periphery around the building fixture, the method comprising the steps of:

permanently fixing the plurality of mating connection means in the periphery around the building fixture; and temporarily fixing the plurality of connection means with the plurality of mating connection means, wherein the panel member covers a portion or all of the building fixture.

7. The method of installing a building fixture protection apparatus as recited in claim 6, the permanent fixating step comprising the substeps of:

drilling a plurality of holes in the periphery around the building fixture; and screwing the threaded screw of each of the plurality of insert receptacles in a corresponding hole provided in the periphery around the building fixture so that the plurality of insert receptacles are flush with the surface of the building fixture periphery.

8. The method of installing a building fixture protection apparatus as recited in claim 6, wherein the panel member comprises one of a wood, plastic, synthetic rubber, or natural rubber material.

9. The method of installing a building fixture protection apparatus as recited in claim 6, wherein the panel member has a thickness in the range of 0.25 inches to 1.0 inches.

10. The method of installing a building fixture protection apparatus as recited in claim 6, wherein the building fixture comprises one of a door or a window.

11. The method of installing a building fixture protection apparatus as recited in claim 6, wherein the building fixture protection apparatus protects the building fixture from damage caused by one of storms or vandals.

12. A window protection apparatus that quickly connects and disconnects from a periphery around an existing window to protect the window from damage, the window protection apparatus comprising:

a panel member sized to cover at least a portion of the window; and a plurality of spring-loaded locking inserts provided at select portions of the panel member, the plurality of spring-loaded locking inserts quickly connecting and disconnecting the panel member to and from a plurality of mating insert receptacles provided in the periphery around the window, wherein each of the plurality spring-loaded locking inserts has a pushbutton release on one end and a detent mechanism on another end, the pushbutton release enabling the detent mechanism to retract upon removal spring-loaded locking insert from its mating insert receptacle, and wherein each of the plurality of mating insert receptacles comprises an insert receptacle for receiving the detent mechanism of the spring-loaded locking insert, and a threaded screw extending from a bottom of the insert receptacle for permanently connecting each mating insert receptacle directly into the periphery around the window.

13. The window protection apparatus as recited in claim 12, wherein the panel member comprises one of a wood, plastic, synthetic rubber, or natural rubber material.

14. The window protection apparatus as recited in claim 12, wherein the panel member has a thickness in the range of 0.25 inches to 1.0 inches.

15. The window protection apparatus as recited in claim 12, wherein the window protection apparatus protects the window from damage caused by one of storms or vandals.

* * * * *